United States Patent [19]

Seybold et al.

[11] 4,093,019

[45] June 6, 1978

[54] METHOD OF PRODUCING SMALL SHAPED PARTS BY CASTING FROM METAL AND APPARATUS FOR PERFORMING THE METHOD

[75] Inventors: Rolf Seybold; Gerd Gross, both of Solingen, Germany

[73] Assignee: Firm Piel & Adey, Solingen, Germany

[21] Appl. No.: 705,784

[22] Filed: Jul. 16, 1976

[30] Foreign Application Priority Data

Jul. 19, 1975 Germany ..... 2532402

[51] Int. Cl.[2] ..... B22D 27/04

[52] U.S. Cl. ..... 164/52; 164/252

[58] Field of Search ..... 164/50, 258, 51, 52, 164/251, 252

[56] References Cited

U.S. PATENT DOCUMENTS 2,388,974 11/1945 Hopkins ..... 164/52

3,914,851 10/1975 Ujiie ..... 164/52 X

FOREIGN PATENT DOCUMENTS 725,539 1/1966 Canada ..... 164/258

*Primary Examiner*—Francis S. Husar

*Assistant Examiner*—John S. Brown

*Attorney, Agent, or Firm*—Holman & Stern

[57] ABSTRACT

The invention relates to a process for the production of small moulded components by die-casting of metals. In this process, the metal to be melted in a crucible is limited to the charge weight for casting in a single die. Heat is supplied electrically and interrupted during casting. A metal heel is retained in the crucible so that its heat content allows compensation of a large part of the heat loss during said interruption of heat supply.

7 Claims, 1 Drawing Figure

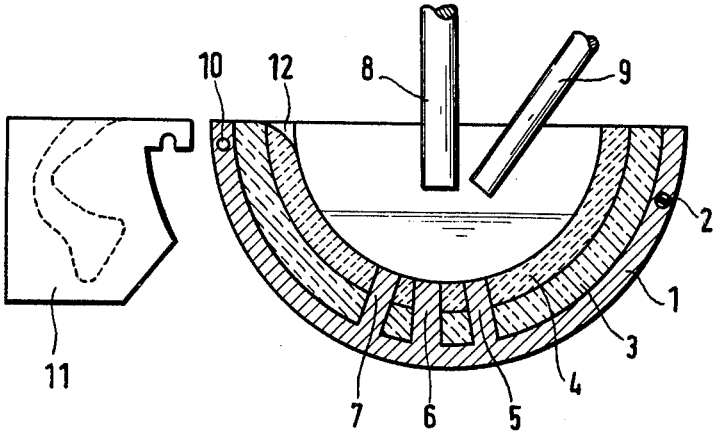
10
12
8
9
2
1
3
4
5
6
7
11

METHOD OF PRODUCING SMALL SHAPED PARTS BY CASTING FROM METAL AND APPARATUS FOR PERFORMING THE METHOD

BACKGROUND OF THE INVENTION

The invention relates to a process for the production of small moulded components by die-casting of crucible-melted metals, particularly alloy steel.

During the course of conventional gravity die-casting processes of the above type very large quantities of heat must be removed from the metal in a very short time after casting, so that the applicability of the process is subject to a limitation resulting from the thermal properties of the die material. With the exception of large ingots or billets other casting processes are selected for alloy steels and other metals, as the melting temperature for these materials is relatively high, and as the physiological heat stressing of die-casting personnel already reaches a limit value when casting non-ferrous alloys subject to considerably lower temperature.

SUMMARY OF THE INVENTION

An object of the invention is to provide a process of the type described above, whereby the use of gravity die-casting is less restricted than previously by the above-named difficulties.

Surprisingly it has been found that gravity die-casting of the said metals, particularly alloy steel, becomes possible when the volume of metal to be crucible-melted and charged into the crucible for each casting is limited to the necessary charge for a single casting in one die; melting heat being supplied from electrical sources and the charge being raised to casting temperature with an interruption in heating during the casting procedure, the contents of the crucible being maintained to a volume of metal for which the heat content allows compensation of a considerable part of the heat loss which occurs when switching off the heating during the casting process, in order to ensure castability.

In this manner the heat stress imposed on casting personnel is limited to the admissible physiological work stress level even in the case of metals with a higher melting temperature.

The process according to the invention leads to the possibility of using die-casting for alloy steels and similar metals, the said metals being similar to alloy steels in respect of their melting temperature and melting heat. The lower melting temperature compared with structural steels also allows casting at a correspondingly lower temperature. Nevertheless, crucible-melting by traditional methods require overheating, in order to ensure the availability of a suitable large reserve of heat for individual castings. This means that in the case of several individual dies required to produce the castings, under the most favourable conditions the last die will receive the metal at the lowest admissible casting temperature. The casting temperature for all other dies will be too high, leading not only to difficulties in dissipating the heat to be removed, but also involving considerable differences in quality within a single melt.

In particular the new process allows the casting temperature to be adjusted accurately by suitable dimensioning of the melt heat input, a procedure which normally fails in traditional casting processes owing to the fact that casting is effected on a falling temperature gradient starting from a maximum value, though still considerably above the technically admissible and possible minimum casting temperature.

The solid metal placed in the crucible can naturally be subjected to preheating in the interests of economic processing. Nevertheless such preheating is not comparable with the overheating to which the charge is subject in the crucible during other processes, and in any case lead to a temperature still below the melting temperature.

As relatively small volumes of molten metal are produced, the conditions for homogeneous mixing are favourable in the event of the make-up of an alloy from several metals added in the solid condition. To protect against undesirable gas reations the small size of the crucible allows the justifiable expense of working under a protective gas screen.

In order to produce the required heat, melting may be undertaken under an electric arc produced either by carbon electrodes or by metal electrodes where it is important to prevent unfavourable carbon pick-up. In particular, welding electrodes consisting of a metal used to form the charge in the crucible are idealy suited. The charge metal input can be extended or made up exclusively in the form of wire, which then requires a suitably large volume as would be required for a single casting. The melting crucible is preferably subject to weight determination allowing very accurate control of the metal input. Where the crucible is secured to a retaining arm, a considerable moment can be induced for the said weight determination, thus allowing very accurate results.

The process according to the invention includes the production of melts under a slag layer. Such a slag layer can for instance be obtained by melting down a suitably selected electrode coating. The slag is held back in a known manner when casting.

In order to carry out the process in accordance with the invention it is possible to use normal traditional dies. In particular those dies made of materials used for casting copper alloys are suitable. Low-carbon and heat-resisting steels are given preference as die materials.

In a preferred design of the apparatus for casting alloy steels, the process is applied in such a manner that the alloy steel to be cast is fed into the crucible in the form of solid particles, the particles covering the bottom of the crucible right from the start of the melting procedure.

The crucible in which the metal is melted by means of electrodes, can be usefully designed in the form of an electrically non-conductive container brought into direct contact with the casting aperture of the die.

The crucible may also be independently fitted with an electrically conductive carrier jacket from which a base electrode extends through the electrically non-conductive layer of the crucible for the purposes of an electric arc electrode above the level of the crucible bottom; in this case the base electrode is already covered with molten steel after a very short period.

In the preferred form of the invention, the electrically non-conductive layer consists of two separate layers of which the lower is a refractory clay-silicate fibre material and the upper layer is a refractory cement.

DETAILED DESCRIPTION OF PREFERRED EMBODIMENTS

Reference should be made to the drawing for further illustration of the invention.

The drawing shows a jacket 1 connected with an electrical supply source by means of the connecting screw 2. The jacket 1 is in the form of a crucible and is faced inside with a layer 3 of clay silicate synethic fibres. Such a clay silicate has a composition of 43–47% $Al_2O_3$, 50–54% $SiO_2$, 0.6–1.8% $Fe_2O_3$, 1.2–3.5% $TiO_2$, traces of MgO, 0.1–1.0% CaO, 0.2–2.0 $Na_2O$, 0.6–1.1% $B_2O_3$ and traces of further inorganic materials in proportions of 0.2–0.3%. The fibres made from this clay silicate are softened or steeped in waterglass then applied in a thickness of 5–20 mm. The layer 3 is then allowed sufficient time to dry out. This particular composition is heat-resistant up to approx. 1600° C. The final layer of refractory mortar 4 is then applied.

As may be seen, base electrodes 5, 6 and 7 extend from the jacket 1 finishing at the surface of layer 4 inside the crucible. The whole of the crucible bottom is first covered with particles of alloy steel melted down immediately under an electric arc from a tungsten electrode 8. A steel melting electrode 9 may also be used optionally, where it is required to introduce steel in this manner.

The crucible consisting of layers 1, 3 and 4 is fitted in the vicinity of the outlet 12 with securing means 10 in the form of a bolt or the like to which the die 11 can be secured optionally. These securing means remain during the casting process and can be removed thereafter to allow a new die to be suspended in position.

We claim:

1. A process for the production of small molded components by casting high alloy steel, and metal alloys similar to said alloy steels with respect to their melting temperatures and melting heat, in a crucible, and particularly, in a gravity die, comprising the steps of:

limiting the maximum amount of metal to be melted down in the crucible at any given time to the charge weight necessary for casting into a single die plus an amount of the metal sufficient to form a metal heel for heat retention;

supplying heat electrically to the charge being heated to casting temperature;

casting the metal into a die;

interrupting the heating of the charge during the casting step; and retaining in the crucible a metal heel during the casting step, the heat content thereof compensating for at least a portion of the heat loss occurring from the metal during the heat interrupting step to maintain the pourability and castability of the metal in the crucible.

2. The process of claim 1, wherein the metal in the solid condition placed in the crucible is subjected to pre-heating.

3. The process of claim 1, wherein the metal to be melted down in the crucible is melted by means of an electric arc.

4. The process of claim 1, wherein the metal to be melted down in the crucible is taken from a length of wire-like material which is fed continuously until the necessary weight for a gravity die-casting has been metered off.

5. The process of claim 1, wherein the metal in the crucible is melted down under protective gas and is poured out of the crucible under a protective gas screen.

6. The process of claim 1, wherein dies are used made from materials normally utilised in copper alloy casting, more particularly using low-carbon and heat-resisting steels as die materials.

7. The process of claim 1, wherein the high alloy steel is introduced in particle form maintaining a cover over the bottom of the crucible.

* * * * *